United States Patent [19]

Grant

[11] Patent Number: 4,518,116

[45] Date of Patent: May 21, 1985

[54] AUTOMATIC DAMPER OPERATOR

[76] Inventor: Willie T. Grant, 400 S. Simms St., Lakewood, Colo. 80228

[21] Appl. No.: 608,931

[22] Filed: May 14, 1984

Related U.S. Application Data

[63] Continuation-in-part of Ser. No. 397,035, Jul. 12, 1982, abandoned.

[51] Int. Cl.[3] ..... F23N 3/00

[52] U.S. Cl. ..... 236/1 B; 236/9 A; 236/94; 251/80

[58] Field of Search ..... 236/1 B, 9, 49, 94; 251/75, 80, 138

[56] References Cited

U.S. PATENT DOCUMENTS

| | | | |
|---|---|---|---|
| 2,271,487 | 1/1942 | Nessell | 236/9 A |
| 3,074,643 | 1/1963 | Nelson | 236/9 A |
| 3,212,350 | 10/1965 | Bradford | 251/80 X |
| 3,251,548 | 5/1966 | Foster | 236/1 B |
| 3,934,797 | 1/1976 | Perlmutter | 236/1 B |
| 3,939,456 | 2/1976 | Curtis et al. | 236/94 X |
| 4,148,435 | 4/1979 | Meyers et al. | 236/49 |
| 4,452,391 | 6/1984 | Chow | 236/49 |

*Primary Examiner*—Harry Tanner

[57] ABSTRACT

A motorized, automatic mechanism for installation in an air register damper housing attachable to damper blades for the purpose of converting said blades from a manual mode of operation to an electrically controlled operation through motor interlock with thermostatic and furnace combustion means. System is comprised of electric motor, with switch operator and lever arm attachable to motor shaft; said lever arm being fastened to linkage mechanism that transfers motor rotation to pivotally mounted damper blades, thereby opening and closing said blades in accordance with thermostatic demands.

5 Claims, 11 Drawing Figures

AUTOMATIC DAMPER OPERATOR

This is a continuation-in-part of application Ser. No. 397,035, filed July 12, 1982 now abandoned.

In residential dwellings, both old and new, the central heating and air conditioning systems utilize various floor, wall, and ceiling air registers as the terminating elements of the furnace duct network through which conditioned air is distributed to the various rooms or zones. Said registers generally have pivotally mounted blades manually rotatable between the open and closed positions through a hand operated mechanism including an operator and linkage system. When required to effect an adjustment to the damper openings for the purpose of altering air flow into subject room said adjustment requires the physical, human manipulation of aforesaid controls.

SUMMARY OF THE INVENTION

The subject electro-mechanical device overcomes this and other disadvantages by providing a motorized, automatic, electrically operated system controlled by thermostatic means. The present invention is comprised of an electric motor means attached to a specified end of a semi-flexible linkage mechanism, said linkage mechanism having its opposite end attached to a connector plate on the primary damper blade within confines of damper housing. The opposite ends of both the primary blade and secondary blades capture individual connector plates that are rigidly attached to each said blades; aforesaid connector plates are interconnected by a translating tie bar which forces all secondary blades to rotate simultaneously with primary damper blade when subject blade is pivoted by aforesaid motor means. Motor means are electrically connected to furnace combustion means through individual room thermostat means, said thermostat means providing control for associated motor(s) in a single room or zone.

Advantages of the motorized automatic drive mechanism permits manually operated units to be fitted with said mechanism and operated as an automatically controlled device; manufacturers of manually adjustable dampers can option for producing an automatically operated air register damper without making major modifications to the basic damper housing framework.

It is preferred that the present device be constructed from materials that are compatible with the specific requirements and general operating conditions normally associated with forced air heating/cooling systems.

It is one of the principal objectives of the present invention to provide a motorized, automatic means for operating single or multiple blade air register dampers.

Another objective is to provide a motorized air register damper system in which motor means are controlled by zone thermostatic means.

These and other objects and advantages of the subject invention will become apparent after considering the specifications and related drawings which cover a preferred embodiment, wherein.

Figure 1:
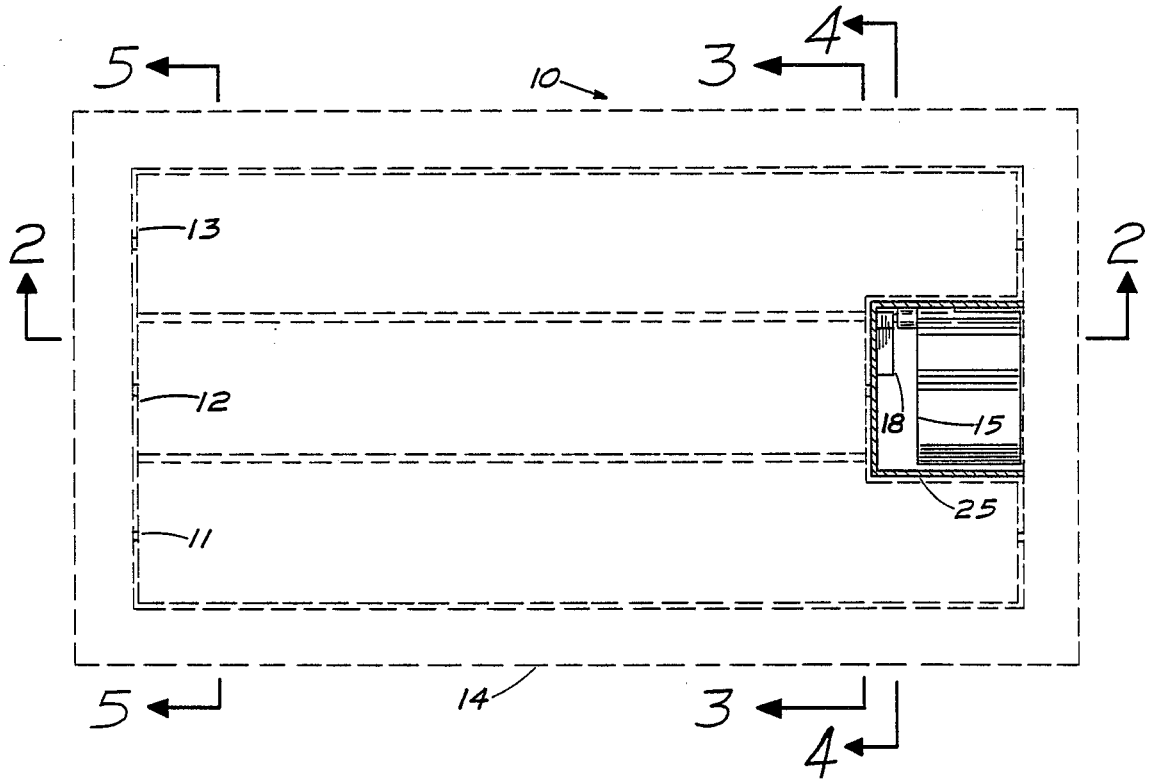
FIG. 1 is a plan view of an automatic drive mechanism showing existing damper housing and blade orientation, (in dashed outline) relative to motor means of present invention.

Referring to the drawings specifically by reference numbers, FIG. 1 shows damper device 10, and damper blades 11, 12, and 13 pivotally mounted in housing 14 with said blades modified to spatially accommodate motor means 15 and primary blade 12 pivotably supported by motor cover 25. In the interest of clarity, FIG. 1 has omitted grille bars 26 that are shown in FIG. 2 and span across the top of housing 14 for dual purpose of distributing air flow and supporting loads placed on or moving across register outlet.

As is well known in the art, when a flexible of semi-flexible member such as linkage 22, said linkage 22 being a bar, length of wire, etc., is deflected within its elastic range, said bar, piece of wire, etc. will store energy as it deflects under the influence of force means as applied by lever arm 21. When the force means is modified or removed, the bar, piece of wire, etc. will release the stored energy and come to a well defined position of equilibrium. When properly directed and controlled, as in the present invention, the released energy can fulfull specific requirements, such as rotating damper blades 11–13 in the manner hereinafter described. Thus, it is to be understood in the description of the operation of linkage 22 which follows, linkage 22, is an energy storing and releasing mechanism deflectable within its elastic range, and, therefore, capable of storing potential energy and releasing it as kinetic energy .

Figure 2:
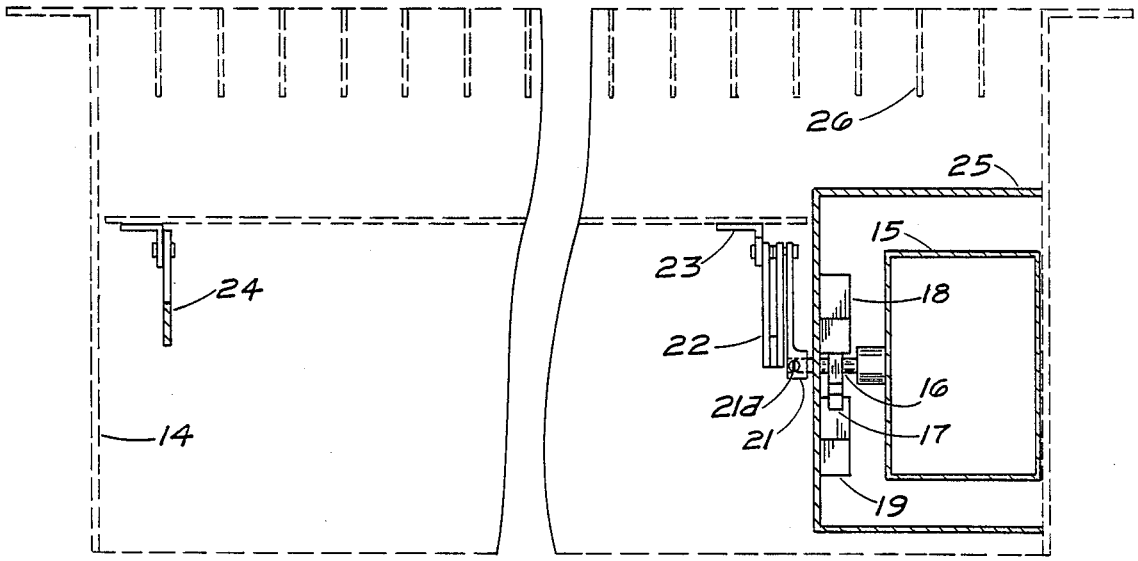
FIG. 2 is a longitudinal cross-sectional view taken along line 2—2 of FIG. 1.
Figure 3:
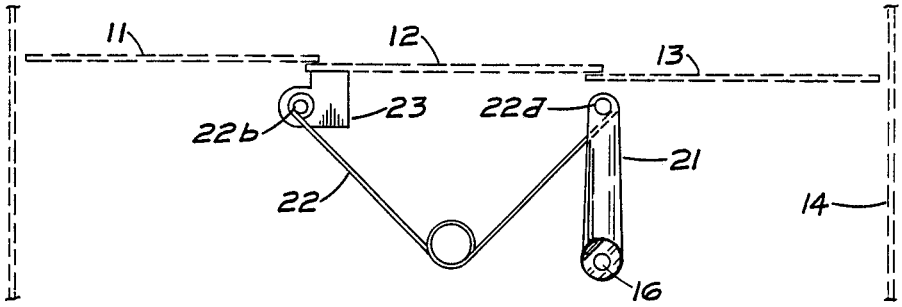
FIG. 3 is a cross-sectional view along line 3—3 of FIG. 1.

To motor shaft 16 shown in FIG. 2 is fixedly attached cam 17 that operates motor control switches 18 and 19—functions to be explained. At the extremity of said motor shaft, lever arm 21 is attached by means of set screw 21*a*, said lever arm being primarily responsible for capturing semi-flexible linkage mechanism 22 by means of pin 22*a* and providing rotational inertia to subject mechanism in cooperation with motor means 15. As shown in FIG. 3, pin 22*b* attaches opposite end of said linkage mechanism pivotally to connector plate 23, said plate being rigidly attached to primary damper blade 12. As can be ascertained from FIG. 3, when lever arm 21 is rotated in a clockwise direction by motor means 15, subject linkage mechanism 22 translates with the characteristics of a rigid mechanism based on the geometrical relationship between damper tie plate 23 and the location of connection pin 22*a* (FIG. 3) in the extremity of lever arm 21. As subject lever arm rotates from its twelve-o-clock position shown in FIG. 3, followed by the related movement of linkage 22, damper plate 12 is coerced to rotate counterclockwise from the horizontally closed position to the preferred vertical and open position shown in the vertical configuration. In cooperation with rotating plate 12, tie bar 24 of FIG.

5, pivotally attached to damper tie plates 11*a*, 12*a*, and 13*a* by pins 11*b*, 12*b*, and 13*b*, transmits the rotation from primary blade 12 to secondary blades 11 and 13, said cooperation culminating in air register 14 having an open damper status in response to thermostatic demands and furnace requirements for room or zone to be heated or cooled.

Subject damper means reach the fully open vertical position when lever arm 21 has rotated to the horizontal position placing pin 22*a* at the numeral three location on an imaginary clock face. As motor 15 continues to revolve lever 21, intent on placing pin 22*a* at the number six position on said clock face, damper means remain in a fully open position as a result of pins 22*a* and 22*b* pivoting in their respective holes, thereby transmitting insufficient force to damper plate 12 to cause additional rotation.

Said damper means operate wholly in conjunction with thermostatic means 20, said thermostat responding to fulfill the temperature requirements of associated room or zone. When subject room requires temperature increase, thermostatic switch 20*a* closes contacts 20*b*–20*c* to complete the circuit incorporating contacts 19*a*–19*b* of switch 19 (previously closed by rotation of cam 17), thereby energizing motor 15 and rotating damper plates to the open position as heretofore described. As cam 17 rotates with motor shaft 16, said cam influences switch 18 to the closed position, thereupon energizing solenoid 27 and urging furnace means to enter a combustion cycle; aforesaid switch actuator 17 simultaneously influences switch 19 to close contacts 19*a*–19*c* to revert motor circuit to the open position, thereby de-energizing said motor 15, leaving damper blades in said open position, and aforesaid contacts 19*a*–19*c* in a closed mode in preparation for next thermostatic command.

Motor means 15 remain de-energized until thermostat 20 has been satisfied, whereupon switch 20*a* (FIG. 6) closes contacts 20*b*–20*d*, thereby completing the circuit which includes aforesaid themostatic contacts, switch 19 and associated closed contacts 19*a*–19*c*, and motor 15. As said motor is energized, lever arm 21 is urged to continue in clockwise revolution for the purpose of closing damper blades 11, 12, and 13 to restrict further communication into subject room or zone controlled by aforesaid thermostat 20. As subject arm 21 rotates pin 22*a* from the imaginary six position to the twelve position, semi-flexible linkage mechanism 22 exhibits its inherent flexible and energy storing characteristics in the resulting movement in order to deflect and accommodate the varying distance between tie plate pin 22*b* and lever arm pin 22*a*—the spatially movable points between which linkage 22 is attached. As said distance between subject points spatially decreases during the pending rotation of damper plates to the closed, horizontal position, lever arm 21 urges linkage mechanism 22 to respond to applied rotational force through internal energy absorption and release and external geometric alignment, concurrently with rotation of said linkage, thereby coercing primary blade 12 to rotate in the reverse or clockwise direction, and through cooperation with tie bar 24, connected to damper means as heretofore described; secondary plates 11 and 13 are influenced to accompany aforesaid primary plate 12 to the closed position; while cam 17 influences switch 18 to return to the open position, and subsequently urges switch 19 to open contacts 19*a*–19*c* for de-energizing motor 15 and prepare system for future cycle through closing of contacts 19*a*–19*b*.

As previously explained, the relative deflection of the ends of linkage 22 about its mid-length causes potential energy to be stored in linkage of FIG. 3. When the potential energy in the coil and tangent members reached a pre-determined value, the end of linkage 22 having pin 22*b* was forced to assist in releasing said stored energy through rotation of the damper blades.

In order for a semi-flexible linkage, shown in FIGS. 2 and 3, to operate as required and precedingly described, said linkage is preferably constructed in the manner of a linear torsional spring or rigid bars having either a flat or linear torsional spring inserted between said bars at the location where said mechanism angularly changes directions, as shown in FIG. 3.

After a complete revolution of lever arm 21, and with pin 22*a* at the twelve position on the imaginary clock face, and damper plates in the horizontal and closed position, cam 17, fixedly attached to shaft 16, forces switch 19 to close contacts 19*a*–19*b* and de-energize motor 15 to prepare system for future combustion cycle when required by controlling thermostat 20. With the change in status of switch 19, associated switch 18 is simultaneously opened by cam 17 to prevent energizing motor means 15 when parallel devices have similar circuits in operation.

Aforesaid motor means 15, providing rotational inertia to mechanical linkage 22 and subsequently to damper plate system, are supportedly attached to housing frame. Fasteners 18*a*, 18*b*, 19*a*, and 19*b* attach respective switch means 18 and 19 to motor cover 25, said cover being mounted to damper frame by similar fastening means. During rotation of motor shaft 16, cam 17 maintains a fixed position on said shaft by virtue of being pressed onto subject shaft through mechanical means, thereby resulting in a non-slip fit. The individual components of the system cooperate to automatically place damper means in an open or closed position consistent with the demands of space control thermostat 20, thereby providing a more effecient control of said space environment and a considerable savings in fuel costs.

Figure 6:
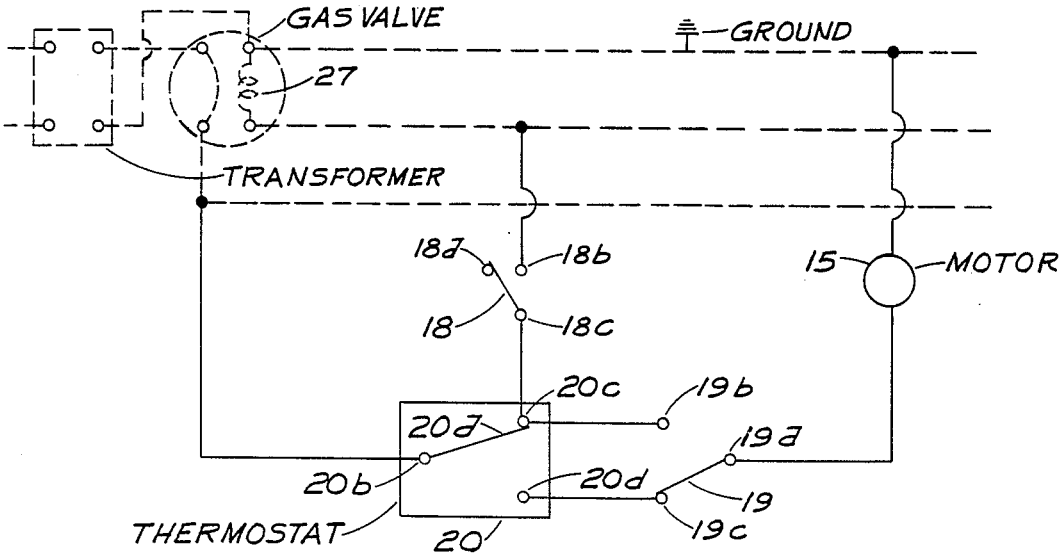
FIG. 6 shows the schematic circuit diagram of the present device and the interface with an associated furnace device.

As heretofore explained said damper means operate under the control of thermostatic means 20 as shown in FIG. 6. However, the circuit of FIG. 6 can be effectively replaced by the circuit shown in FIG. 7 and a more functional operation of the damper operator effected.

Figure 7:
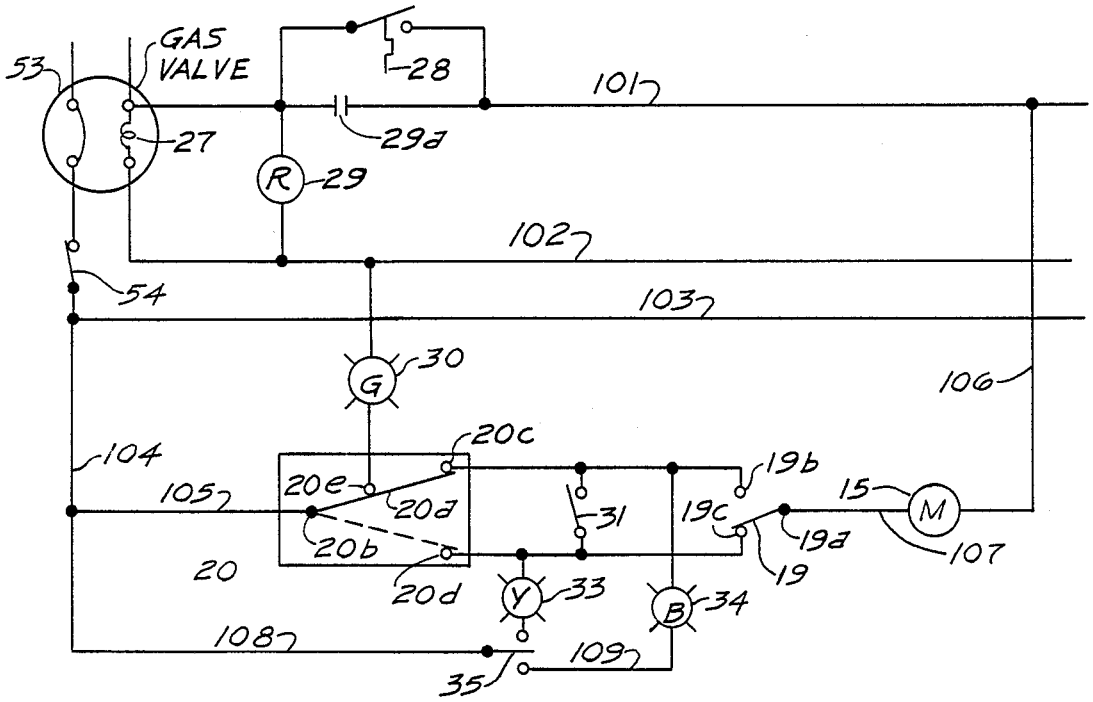
FIG. 7 shows a more detailed schematic circuit diagram.

Turning to FIG. 7 it can be observed that when a temperature adjustment is required, thermostatic switch 20*a* moves to the solid line position to energize motor means 15 through the conductor network, switch lever 19, in the dashed line position, and high temperature thermostat 28. As motor means 15 rotates damper plate 12 to the open position, cam 17 moves switch lever 19 to the solid line position closing contacts 19*a* and 19*c*, preparing the circuit for the next operation. The closing of contacts 20*b* and 20*e* of thermostat 20 energizes solenoid 27 of fuel control means 53, plaicing the heating-/cooling device in an operational mode; said contact closure permits relay 29 to be energized to close contacts 29*a*. While the heating/cooling device is in a heating mode, thermostat 28, being mounted in the furnace flue or a like location of high temperature, opens at a predetermined temperature and remains open until the operating cycle ceases and the internal temperature decreases; relay 29 is also deenergized when room thermostat 20 is satisfied and thermostatic switch 20*a* moves to the dashed line position; contacts 29*a* likewise open.

Opening of said contacts and said thermostat 28 leaves damper plate 12 in an open position, permitting residual conditioned air to be blown from the heating-/cooling device into the room for the duration of the blower cycle of said heating/cooling device. As the temperature in said device decreases, thermostat 28 closes allowing damper plate 12 to be closed by motor means 15; said motor means being energized through the solid line position of switch lever 19 and thermostat 28.

Figure 4:
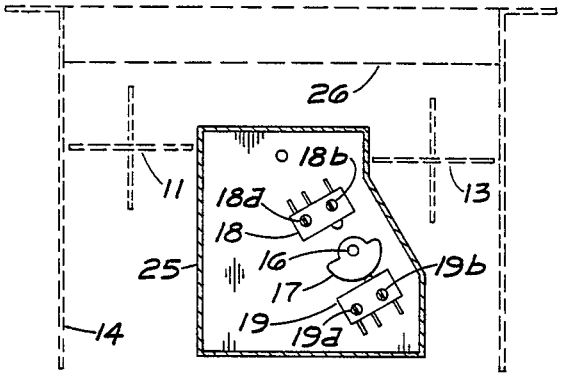
FIG. 4 is a cross-section along line 4—4 of FIG. 1.
Figure 5:
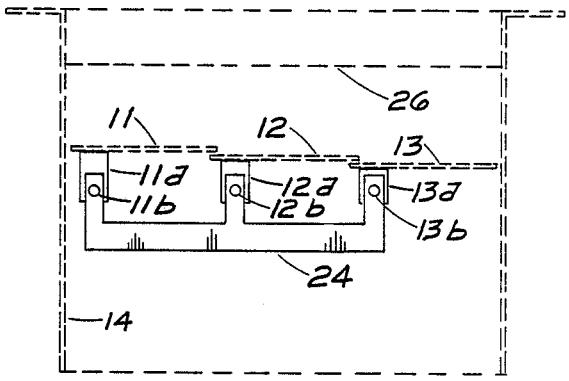
FIG. 5 is a cross-section along line 5—5 of FIG. 1.

To prevent deenergization of motor means 15 when damper blade 12 is partially open and the position of thermostat lever 20*a* is prematurely changed, holding switch 31, shown in FIG. 7, is incorporated into the circuit to be operated by a cam similar to cam 17 shown in FIG. 4. Switch 31 is held in a closed position by said cam until the damper plates are either fully open or fully closed.

Manually operated switch 54 provides a means to electrically disengage all damper circuits from the central heating/cooling device, while manually operated switch 35 allows motor means 15 to be operated independently of thermostat 20 to open or close said damper plates.

Light means 30, being an indicator light, visibly shows when a room thermostat is energizing the fuel control solenoid 27, and lights 33 and 34 provide an indication of the open or closed position of damper plate 12 when motor means 15 is being controlled by three-way manual switch 35.

The foregoing description of the operation of the automatic damper means is based on electrical components having interconnections through means of electrical conductors. The following description provides for operation of the damper means by remote control means using radio frequency (RF) signals.

Figure 8:
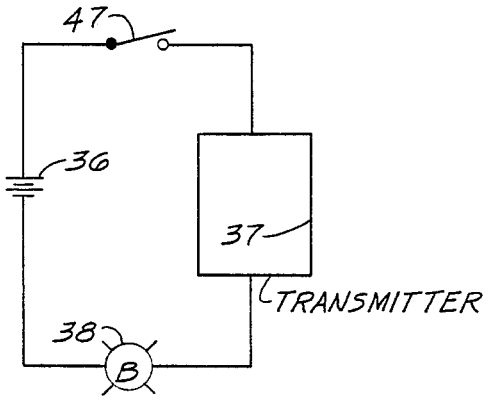
FIG. 8 is a first transmitter circuit for a radio frequency (RF) control system.
Figure 9:
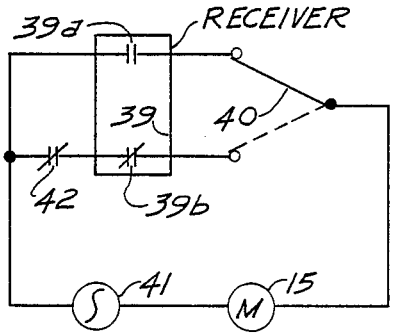
FIG. 9 is a radio frequency remote control circuit for a damper motor.
Figure 10:
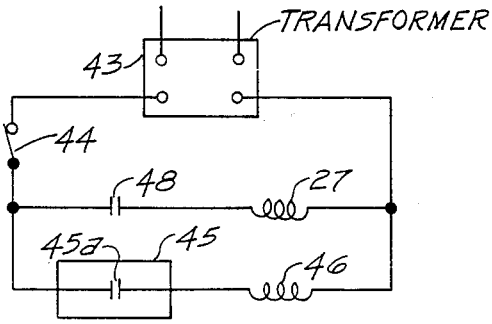
FIG. 10 is a radio frequency remote control circuit for a heating/cooling device.
Figure 11:
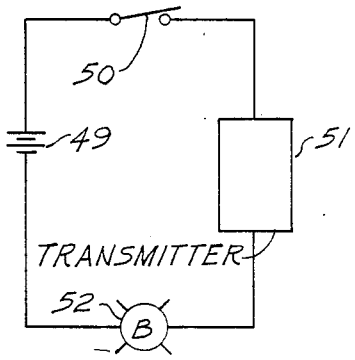
FIG. 11 is a second transmitter circuit for a radio frequency control system.

Thermostatic switch 20*a* of FIG. 8 functions as an instant on-off switch between electrical source 36 and RF transmitter 37. When a given room requires a temperature adjustment, thermostatic switch 47 closes to energize transmitter 37 and indicator light 38; said transmitter sends a first RF signal to receiver 39 (FIG. 9) of damper means 10, said damper means being operated by motor means 15; said signal momemtarily opening contacts 39*b* while closing contacts 39*a* and energizing motor means 15 through solid line position of switch 40, thereby beginning the rotation of damper blades 11–13 to the open position. When the RF signal terminates and receiver 39 deenergizes, contacts 39*a* return to the normally open position and contacts 39*b* return to the normally closed position while motor means 15 continues to be energized through normally closed contacts 42 of time delay means, closed contacts 39*b*, and the dashed position of switch 40.

As the damper blades reach the fully open position, switch 40 is returned to the solid line position and motor means deenergized; and switch 50 is momentarily closed causing transmitter 51 to send an RF signal to receiver 45 which momentarily closes normally open contacts 45*a*, energizing latching relay coil 46 which closes contacts 48 and thereby energizes fuel control means solenoid 27, to initiate a combustion cycle of the heating/cooling device.

When thermostatic means, having thermostatic switch 47, is satisfied and momentarily closes said switch 47, a brief RF signal is sent to receiver 39 by transmitter 37. Motor means 15 is momentarily energized through momentarily closed contacts 39*a* and solid line position of switch 40. However, as said RF signal terminates, and just prior to the deenergization of receiver 39 and opening of contacts 39*a*, switch 40 is moved by rotating cam means to the dashed line position. Although contacts 39*b* close when contacts 39*a* open, motor means 15 is deenergized as a result of time delay contacts being switched to an open position when motor means began rotation of damper means to the closed position.

Simultaneous with the initial rotation of motor means 15, switch 50 is momentarily closed to energize receiver 45 through transmitter 51, thereby unlatching contacts 48 of said latching relay through momentary closure of contacts 45*a* and energization of coil 46—fuel control means being thereby deenergized.

After a preset time period has lapsed, allowing residual conditioned air to be blown from the plenum of the heating/cooling device, said time delay relay closes contacts 42, and motor means 15 is energized through now closed contacts 42 and 39*b* and dashed position of switch 40. When the damper blades reach the fully closed position, switch 40 is moved by cam means to the solid line position and the motor means is deenergized through a first open circuit having presently open contacts 39*a* and a second open circuit having the dashed line position of switch 40—being presently open.

It can be seen that a single transmitter 37 can be used to operate receivers 39 and 45 simultaneously by having both receivers set to accept the signal transmitted by the single transmitter 37. Accordingly, all primary functions heretofore described will be identically performed by the single transmitter-dual receiver combination.

Thus, there has been shown and described an improved automatic, motorized drive mechanism which fulfills all of the objects and advantages sought after. Many changes, modifications, variations, and other uses and applications of the present invention will become apparent to those skilled in the art after considering this specification and accompanying drawings. All such changes, modifications, variations, other uses and applications which do not depart from the spirit and scope of the invention are deemed to be covered by the invention which is limited only by the claims which follow.

I claim:

1. Automatic damper operating means being a part of damper means, said damper means having enclosure means controlling and regulating the flow of a heating-/cooling medium; said medium being transported through a duct network, said duct network originating at a heating/cooling device and terminating in a plurality of rooms and zones; said operating means comprising;

(a) transmission means, said transmission means comprising motor means and linkage means; said motor means connecting to a first linkage of said linkage means through rotatable shaft means; said first linkage having energy storing and energy releasing means; said first linkage interconnecting said motor means and said damper blades, and transferring motor rotation to said damper blades; a second linkage of said linkage means rotatably interconnecting said multiplicity of blades; said blades being pivotally mounted in said enclosure means;

(b) control means, said control means having thermostatic switch means, said thermostatic switch means controllably interconnecting and energizing said motor means and a fuel control means of a heating/cooling device, (c) indicating means, said indicating means comprising visible means or like means connecting to said thermostatic means and communicating the operational status of said heating/cooling device and the open/closed status of said damper blades.

2. The means defined in claim 1 wherein said control means having relay means and high temperature thermostatic means electrically connecting said motor means to said fuel control means and controlling the operation of said motor means and said fuel control means in combination with automatically and manually operated switch means.

3. Automatic damper operating means being a part of damper means; said damper means having enclosure means controlling and regulating the flow of a heating/cooling medium; said medium being transported through a duct network; said duct network originating at a heating/cooling device and terminating in a plurality of rooms and zones; said operating means comprising;

(a) transmission means, said transmission means comprising motor means an linkage means; said motor means connecting to a first linkage of said linkage means through rotatable shaft means; said first linkage having energy storing and energy releasing means; said first linkage interconnecting said motor means and said damper blades, and transferring motor rotation to said damper blades; a second linkage of said linkage means rotatably interconnecting said multiplicity of blades; said blades being pivotally mounted in said enclosure means;

(b) control means;

said control means having thermostatic switch means, said thermostatic switch means controllably interconnecting and energizing said motor means and a fuel control means of a heating/cooling device, (c) indicating means, said indicating means comprising visible means or like means connecting to said thermostatic means and communicating the operational status of said heating/cooling device and the open/closed status of said damper blades.

4. The means defined in claim 3 wherein said enclosure means comprising a damper housing having grille bars spanning over said multiplicity of damper blades; said blades rotatable by said first linkage having energy storing means and connecting to said motor means.

5. The means defined in claim 3 wherein said control means comprising transmitter means and receiver means of radio control means operable by said thermostatic switch means and cooperating with automatic and manual switch means to operate said fuel control means and control means; said transmitter means communicating radio frequency (RF) signals to compatible receiver means, said receiver means being a part of circuits controlling and energizing other circuit components comprising time delay means, latching means, said motor means and fuel control means; said time delay means electrically holding a prescribed set of damper blades in an open position for a selected time period, said latching means operating said fuel control means in combination with said receiver means.

* * * * *